US006152635A

United States Patent [19]

Wu

[11] Patent Number: 6,152,635

[45] Date of Patent: Nov. 28, 2000

[54] HOUSEHOLD CLEANING EQUIPMENT

[76] Inventor: Chia-Hao Wu, P.O. Box 82-144, Taiwan, Taiwan

[21] Appl. No.: 09/432,381

[22] Filed: Nov. 1, 1999

[51] Int. Cl.[7] ..... A46B 11/00; A47L 13/20

[52] U.S. Cl. ..... 401/270; 401/27; 401/39; 401/138; 401/139; 401/150; 15/172

[58] Field of Search ..... 401/25, 27, 37, 401/39, 137, 138, 139, 143, 146, 149, 150, 270; 15/172, 176.3, 176.5

[56] References Cited

U.S. PATENT DOCUMENTS

| | | | |
|---|---|---|---|
| 3,118,166 | 1/1964 | Bell | 401/25 |
| 4,776,716 | 10/1988 | Huang | 401/139 |
| 4,962,561 | 10/1990 | Hamilton | 15/111 |
| 5,536,095 | 7/1996 | Diamond | 401/146 |
| 5,908,255 | 6/1999 | Branch | 401/139 |
| 6,065,890 | 5/2000 | Weitz | 401/146 |

*Primary Examiner*—Henry J. Recla
*Assistant Examiner*—Peter deVore
*Attorney, Agent, or Firm*—A & J

[57] ABSTRACT

A household cleaning equipment includes a hollow handle filled up with a liquid detergent, piston means mounted in a hole on the handle and driven to pump the liquid detergent out of the handle, and a brush head coupled to the front end of the handle and having a through hole connected to the output port of the piston means, whereby the cleaning equipment can be rapidly engaged with various kinds of brush heads as required.

8 Claims, 22 Drawing Sheets

HOUSEHOLD CLEANING EQUIPMENT

BACKGROUND OF THE INVENTION

1. Field of the Invention

This invention relates to a household cleaning equipment which generally includes a hollow handle and a brush head coupled to the front end of the handle, wherein the handle has a piston means driven to pump a liquid detergent out of the handle to the brush head for cleaning things.

2. Description of the Prior Art

When cleaning household things with a cleaning brush, a detergent may be separately applied. FIG. 25 shows a cleaning brush which supplies a detergent when brushing. As illustrated, the cleaning brush comprises a hollow handle (1) having a rear open end closed by a cap (11) and a front end fixedly mounted with a coupling (2), and a brush head (4) coupled to the coupling flange (21) of the coupling (2) and secured in place by a locking device (3). The locking device (3) comprises a locking plate (31) inserted through a hole (23) in the coupling flange (21) into a hole (41) in the brush head (4). By opening the cap (11), a detergent can be filled into the hollow handle (1). The coupling (2) has a center through hole (22). The detergent is guided out of the hollow handle (1) through a bottom hole (12) and a gap (13) to the center through hole (22) and then to the brush head (4). Referring to FIGS. 26, 27 and 28, the detergent (94) is forced by the pressure itself to pass through the bottom hole (12), the gap (13), the center through hole (22) to the brush head (4). However, when the brush head (4) rubs against a wet place, water (95) will be forced to flow back to the inside of the handle (1) to dilute the concentration of the detergent (94) and to contaminate the detergent (94). Another drawback of this structure of cleaning brush is that the locking plate (31) of the locking device (3) tends to be damaged during the use of the cleaning brush. Still another drawback of this structure of cleaning brush is that the detergent (94) cannot be stopped from flowing out of the handle (1) and the brush head (4). Furthermore, when the brush head 4 is lifted to clean an overhead area, the detergent (94) cannot flow out of the handle (1) to the brush head (4) for application.

FIGS. 29, 30, and 31 show a household cleaning equipment according to the prior art. This structure of household cleaning equipment comprises a sink (5) for holding a detergent, a hot water valve (61) and a cold water valve (62) bilaterally disposed at the bottom side of the sink (5), a mixing chamber (not shown) connected between the hot water valve (61) and the cold water valve (62), a water flow rate control lever (6) for controlling the flow rate of water and its temperature, a hose (54) having one end connected to the mixing chamber and an opposite end connected to a brush head (55), an upright venturi tube (51), and a detergent supply tube (53) having one end connected to the bottom hole (52) of the upright venturi tube (51) and an opposite end connected to the hose (54). The structure of household cleaning equipment cannot stop the detergent from flowing out of sink (5) to the brush head (55), and the detergent is continuously supplied to the brush head (55) when the household cleaning equipment is operated.

SUMMARY OF THE INVENTION

This invention relates to a household cleaning equipment which generally includes a hollow handle and a brush head coupled to the front end of the handle, wherein the handle has a piston means driven to pump a liquid detergent out of the handle to the brush head for cleaning things.

According to the preferred embodiment of the present invention, the household cleaning equipment comprises an elongated hollow handle provided with an end cap for permitting a detergent to be filled therein, a depressing assembly mounted on the handle and including a cylinder fitted within the handle, a collar threadedly engaged with an upper end of the cylinder, a button arranged above the collar, a piston fitted within the cylinder, a shaft having an upper end extending upwardly through the collar to engage with the button and a lower end extending downwardly to engage with the piston, a first ball fitted within the cylinder, a first spring arranged within the cylinder, and an inlet connector connected to a lower end of the cylinder, a tool head formed with an elongated opening close to a front end adapted to receive a pushbutton, and a brush assembly provided with a tubular portion at the central portion, a spring-loaded tubular member fitted within the tubular portion formed with an upper spiral track at an end, a lower spiral track on a cylindrical surface and close to another end, and two grooves at two opposite sides extending longitudinally through the lower spiral track.

It is the primary object of the present invention is to provide a household cleaning equipment which can be rapidly engaged with various kinds of brush heads as required.

It is another object of the present invention is to provide a household cleaning equipment which is easy to operate.

It is still another object of the present invention is to provide a household cleaning equipment which is simple in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
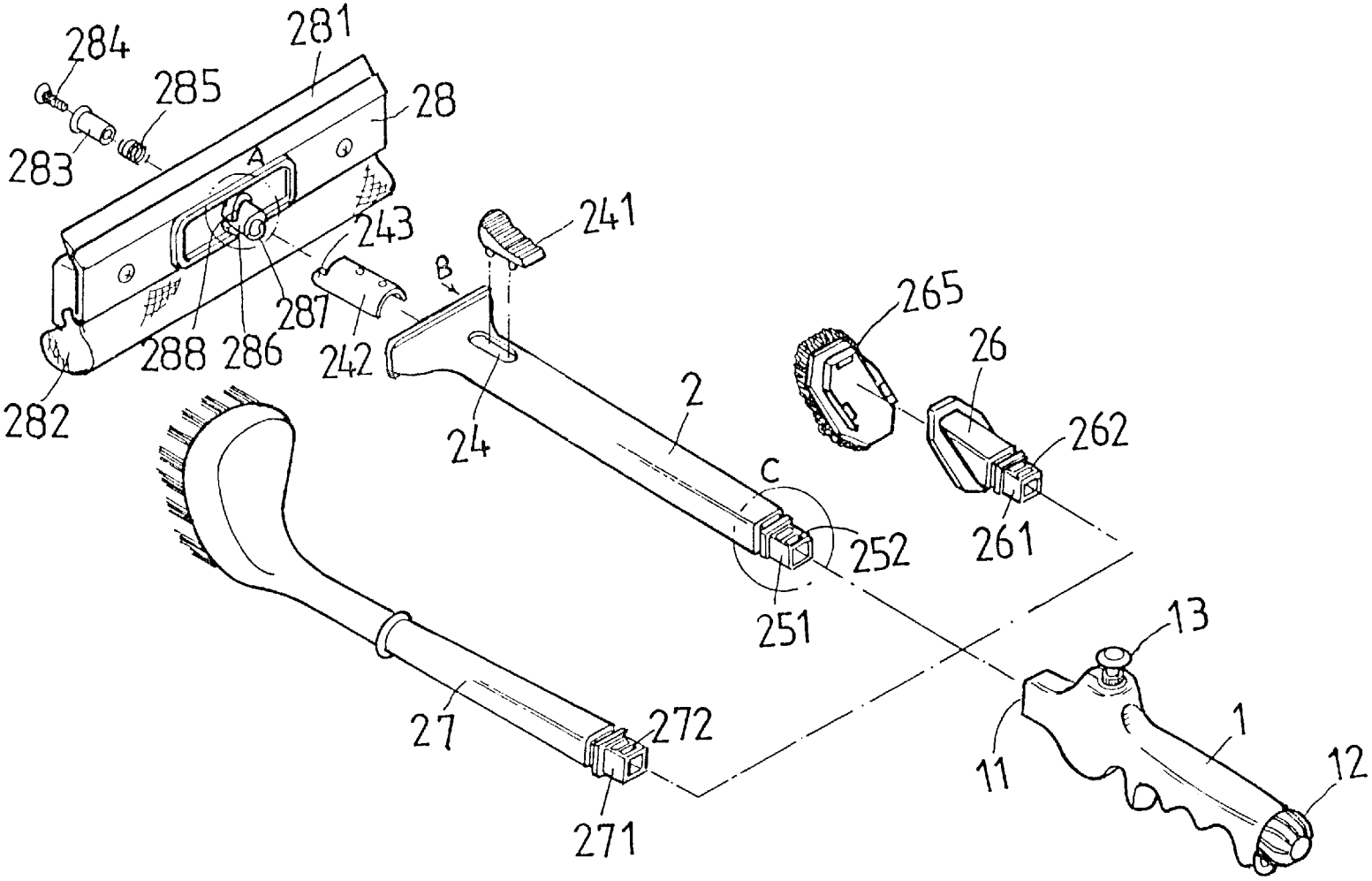
FIG. 1 is an exploded view of a cleaning brush according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 5:
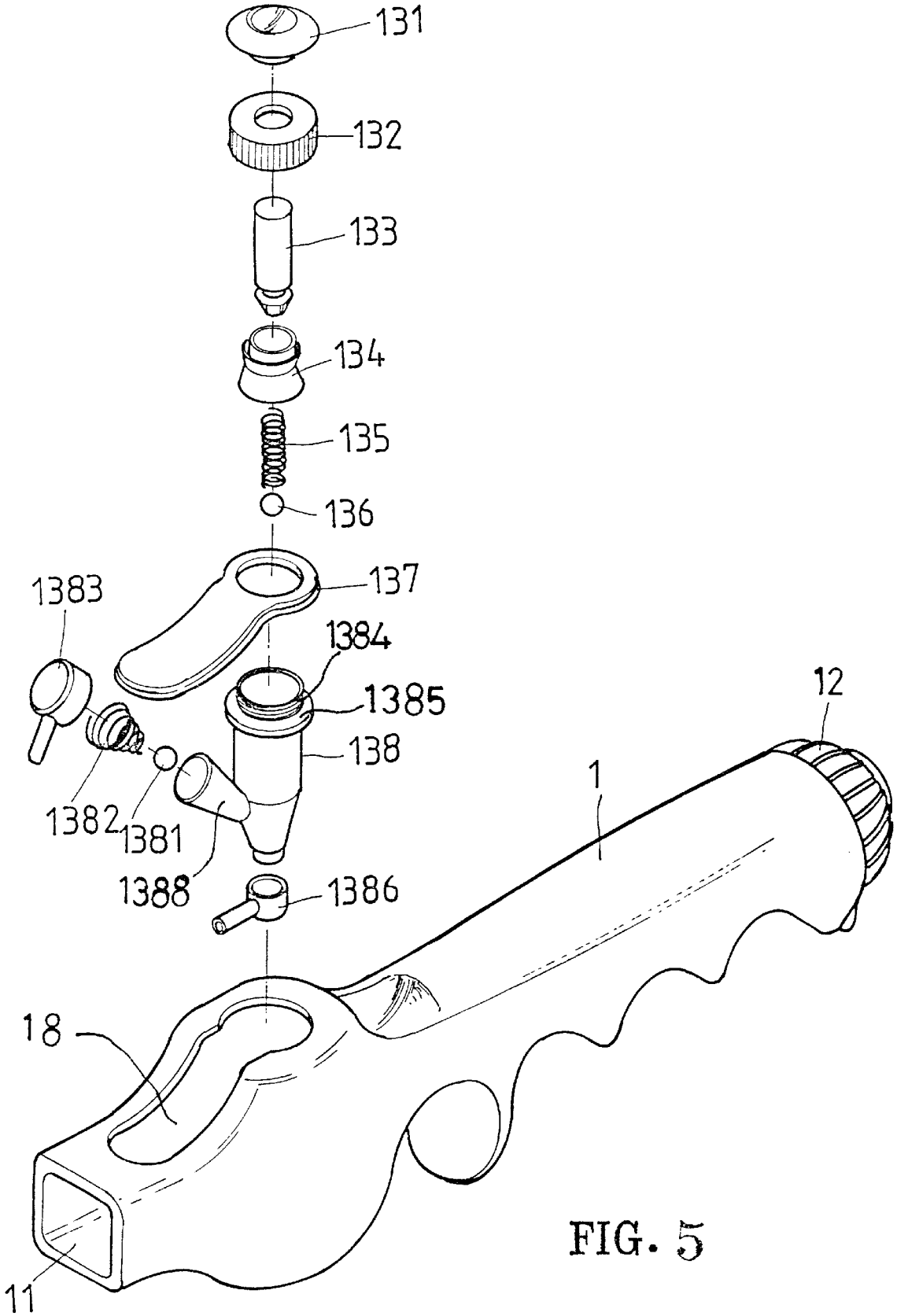
FIG. 5 is an exploded view of the depressing assembly.
Figure 6:
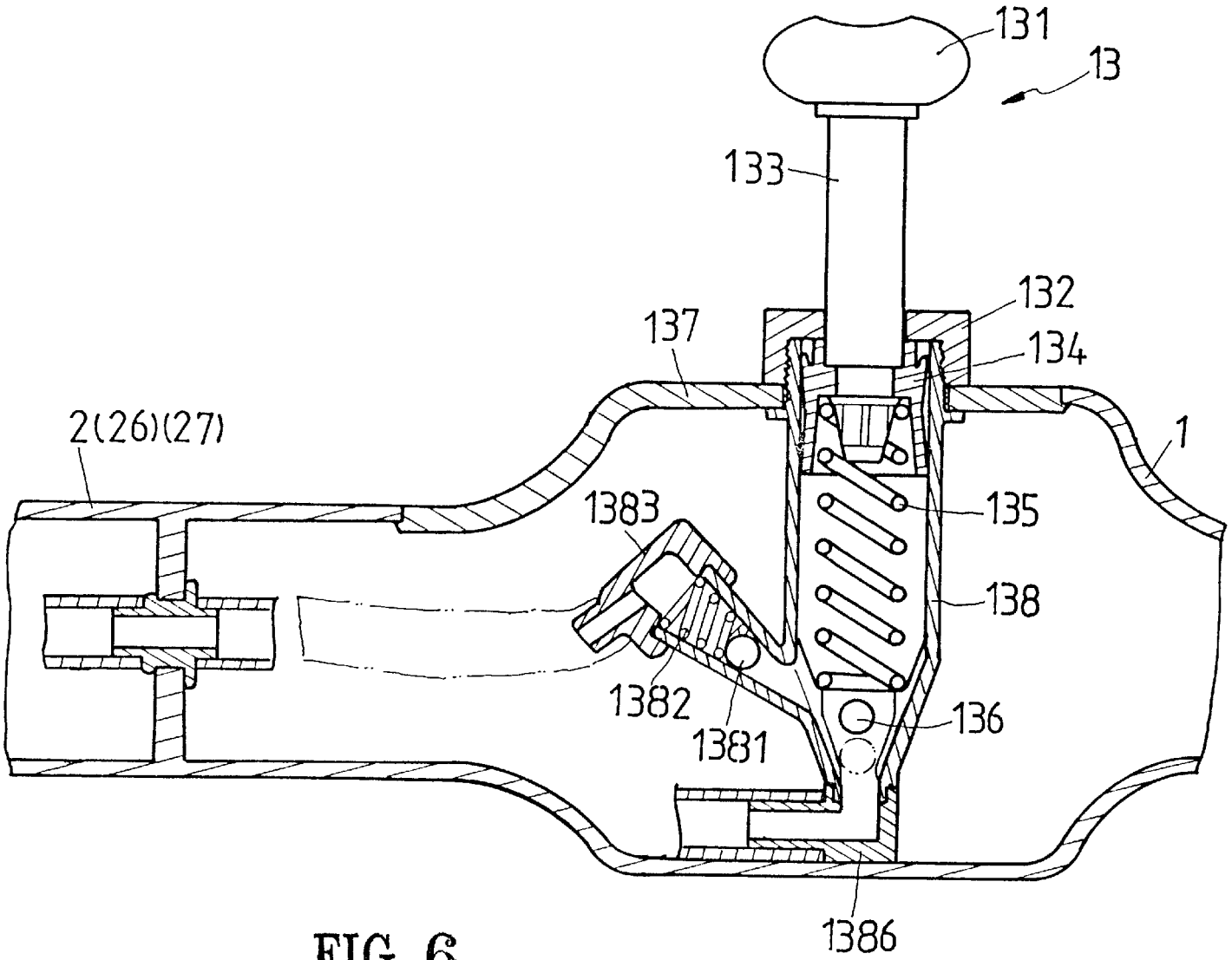
FIG. 6 is a sectional view of the depressing assembly with the button released.
Figure 7:
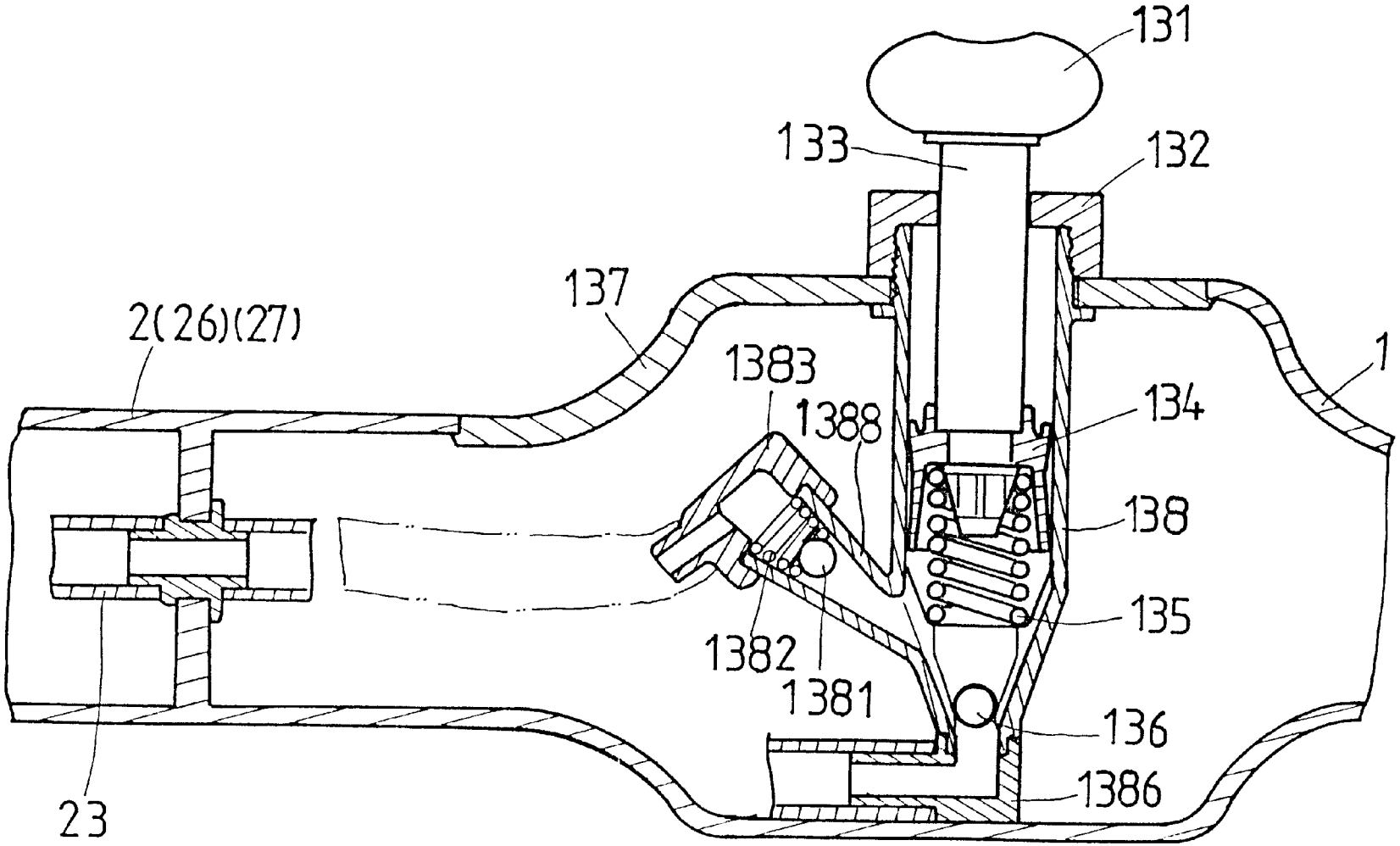
FIG. 7 is a sectional view of the depressing assembly with the button depressed.
Figure 9:
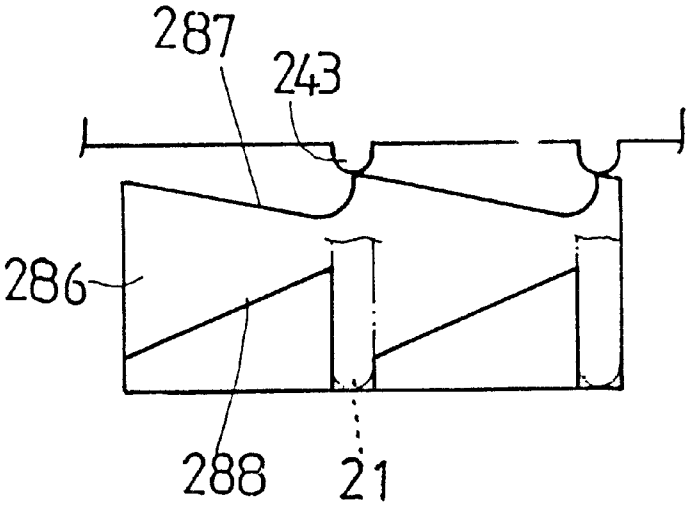
FIG. 9 illustrates the relationship between the tubular portion of the brush assembly and the push member shown in FIG. 8.
Figure 8:
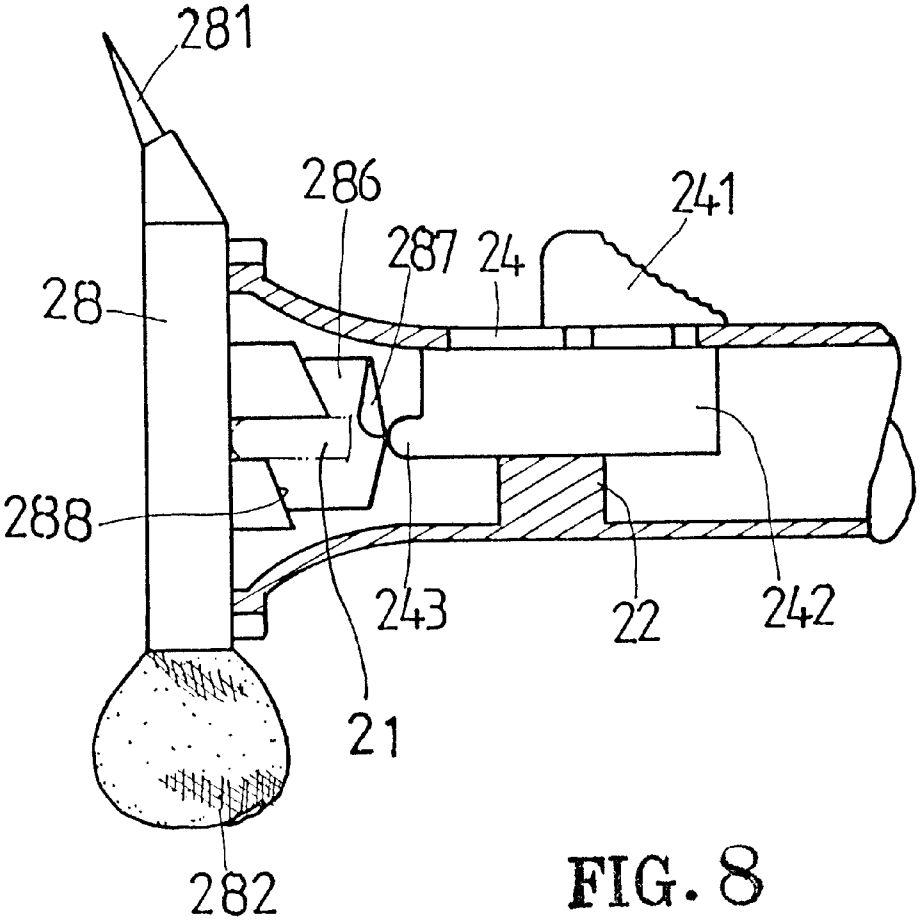
FIG. 8 illustrates the engagement between the tool head and the brush assembly.
Figure 11:
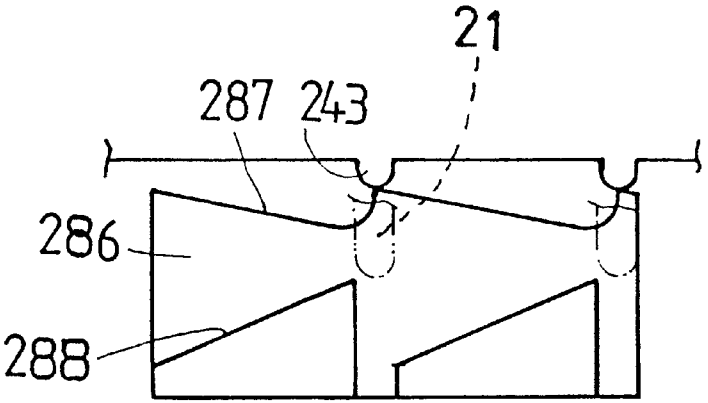
FIG. 11 illustrates the relationship between the tubular portion of the brush assembly and the push member shown in FIG. 10.

Referring to FIGS. 1, 2, 3 and 4, the cleaning brush according to the present invention comprises a handle 1 which is an elongated hollow member formed at an inner end 11 with projections ill adapted to engage with recesses 252, 262 and 272 of different tool heads 2, 26 and 27. The handle 1 is provided with an end cap 12 for permitting a detergent to be filled therein. A depressing assembly 13 is mounted in an opening 18 formed on the top of the handle 1 and located close to the inner end 11 of the handle 1. As shown in FIGS. 5 and 6, the depressing assembly 13 includes a cylinder 138 fitted within the opening 18 of the handle 1 and having a threaded portion 1384 at the upper end extending upwardly out of the opening 11 and a flange 1385 below the threaded portion 1384 bearing against the bottom of the opening 18, a annular ring-like collar 132 threadedly engaged with the threaded portion 1384 of the cylinder 138 to fix the cylinder 138 in place, a button 131 arranged above the collar 132, a piston 134 fitted within the cylinder 138, a shaft 133 having an upper end extending upwardly through the collar 132 to engage with the button 131 and a lower end extending downwardly to engage with the piston 134, a ball 136 fitted within the cylinder 138, a spring 135 arranged within the cylinder 138 and having an upper end bearing against the bottom of the piston 134 and a lower end bearing against the ball 136, and an inlet connector 1386 connected to the lower end of the cylinder 138. The cylinder 138 is formed with a conical tubular portion 1388 which makes an angle with the cylinder 138. Within the the conical tubular portion 1388 are fitted a ball 1381 and a spring 1382 having a lower end bearing against the ball 1381. An outlet connector 1383 is connected with the upper end of the conical tubular portion 1388 of the cylinder 138. As the button 131 is depressed, the piston 134 will be moved down to press the liquid detergent thereby urging the ball 136 against the outlet of the inlet connector 1386 and forcing the ball 1381 to open the conical tubular portion 1388 and therefore, forcing the liquid detergent out of the outlet connector 1383 (see FIGS. 6 and 7). When the button 131 is released, the spring 135 will force the button 131, the piston 134 and the shaft 133 to move upwardly to their former positions thus causing ball 136 to open the cylinder 138 and producing a sucking force to attract the ball 1381 to close the conical tubular portion 1388, so that the liquid detergent is sucked into the cylinder 138 through the inlet connector 1386. Consequently continuously pressing and releasing the button 1 causes the detergent to be continuously sucked into the cylinder 138 and then driven out of the outlet connector 1383 to the tool head 2, 26 or 27 for application.

Figure 3:
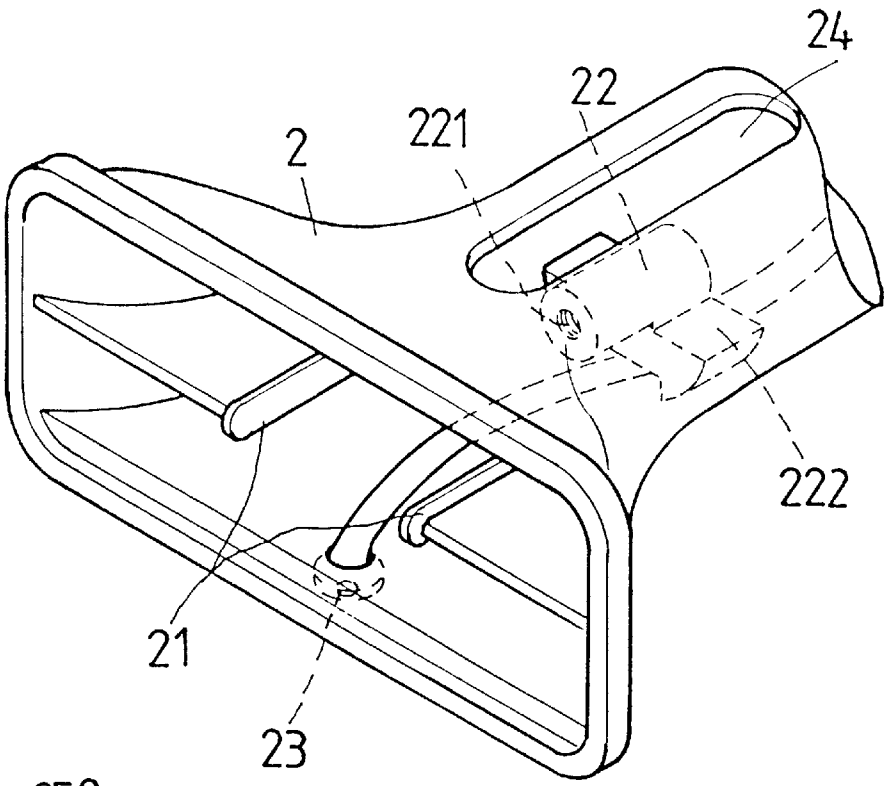
FIG. 3 is an enlarged view of portion B of FIG. 1.
Figure 2:
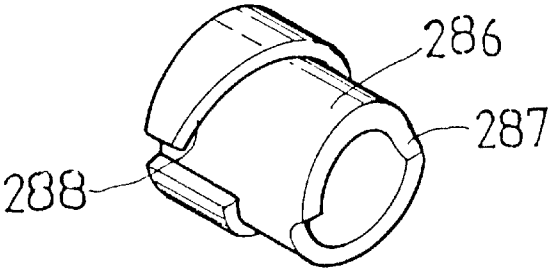
FIG. 2 is an enlarged view of portion A of FIG. 1.
Figure 4:
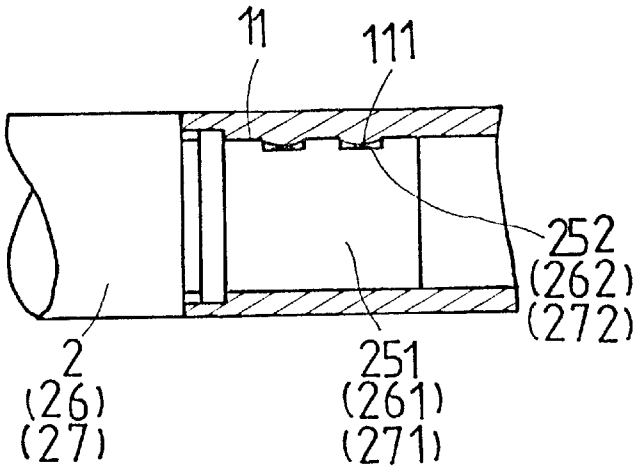
FIG. 4 is an enlarged view of portion C of FIG. 1.
Figure 10:
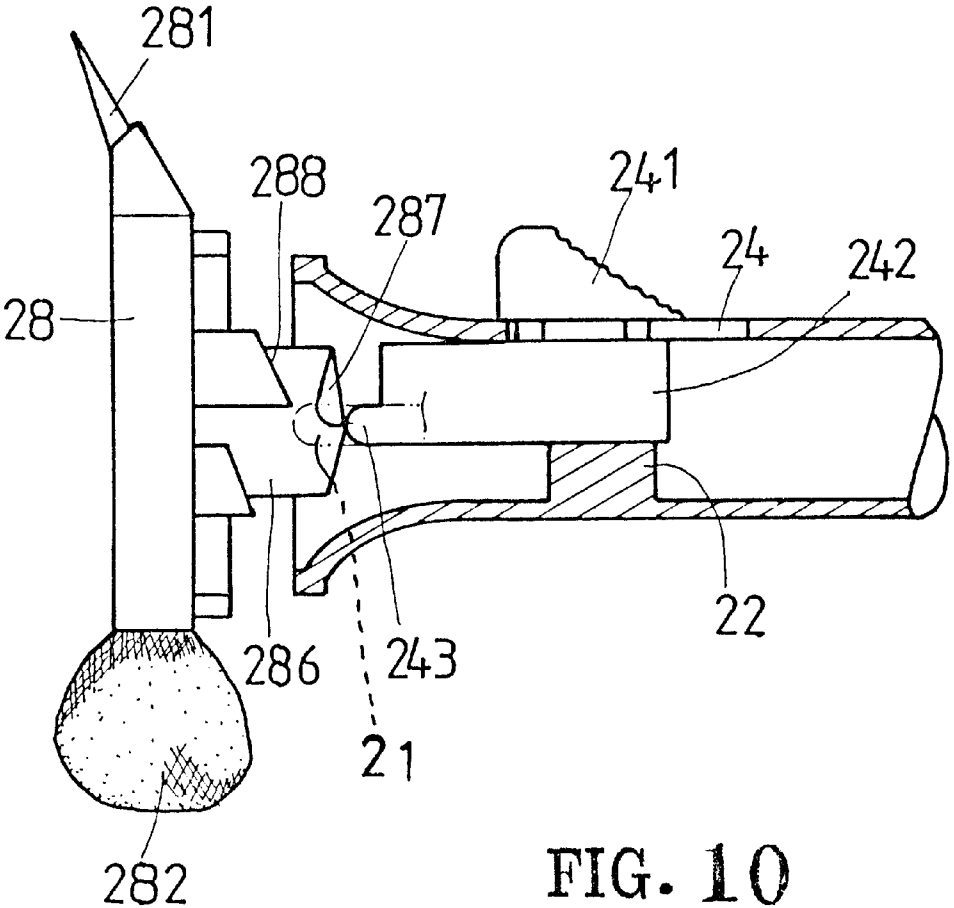
FIG. 10 illustrates how the tubular portion of the brush assembly is moved by the push member.
Figure 16:
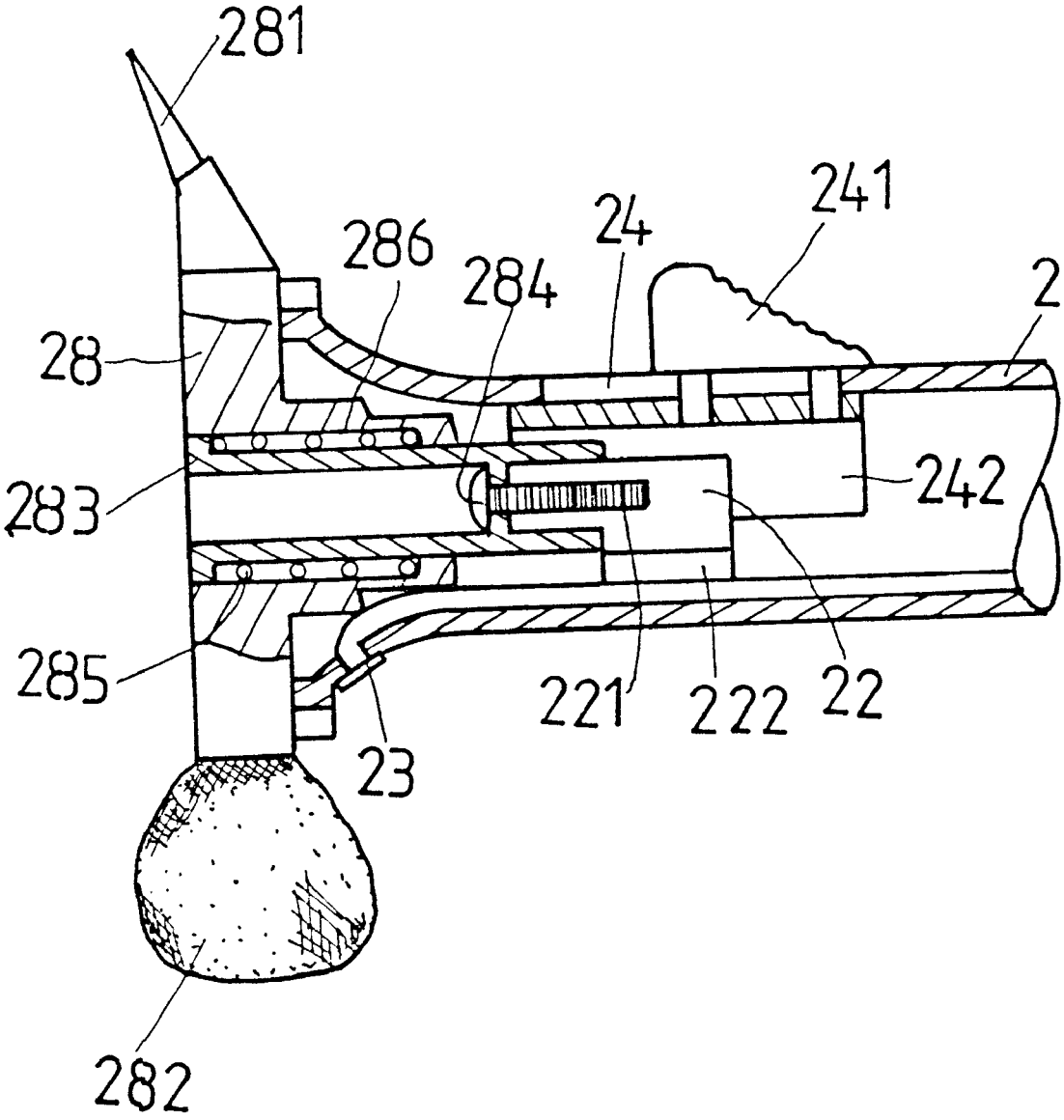
FIG. 16 is a sectional view illustrating how the brush assembly is fixedly engaged with the tool head.

Referring to FIGS. 1, 2 and 3, the tool head 2 is formed with an elongated opening 24 close to its front end adapted to receive a pushbutton 241. A push member 242 is fitted within the tool head and fixedly engaged with the bottom of the pushbutton 241. The push member 242 has a protuberance 243 at the front end. The interior of the tool head 2 is provided with two guiding members 21 transversely extending from two opposite inner walls of the tool head 2, a fixing member 22 arranged between the two guiding members 21 and having a threaded hole 221 at the center and two arms 222 at two opposite sides, and an orifice 23 at the bottom for connecting to the outlet connector 1383 via a pipe. As shown in FIG. 16, the tool head 2 is provided with a brush assembly 28 which is provided with a sponge 281 at one side and a scraper 281 at the other. A tubular portion 286 is provided at the central portion of the inner side of the brush assembly. The tubular portion 286 has an inwardly extending flange 2861 at the outer end. A tubular member 283 enclosed with a spring 285 is fitted within the the tubular portion 286 and has an inner end fixedly engage with the fixing member 22 by a screw 284. The spring 285 is used for keeping the position of the brush assembly 28. The tubular portion (see FIGS. 2 and 10) is formed with an upper spiral track 287 at the right end, a lower spiral track 288 on the cylindrical surface and close to the other end, and two grooves 2881 at two opposite sides extending longitudinally through the lower spiral track 288.

Figure 13:
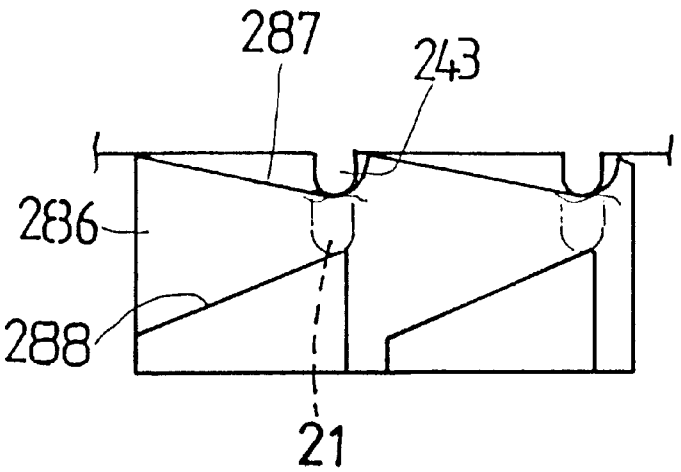
FIG. 13 illustrates the relationship between the tubular portion of the brush assembly and the push member shown in FIG. 12.
Figure 12:
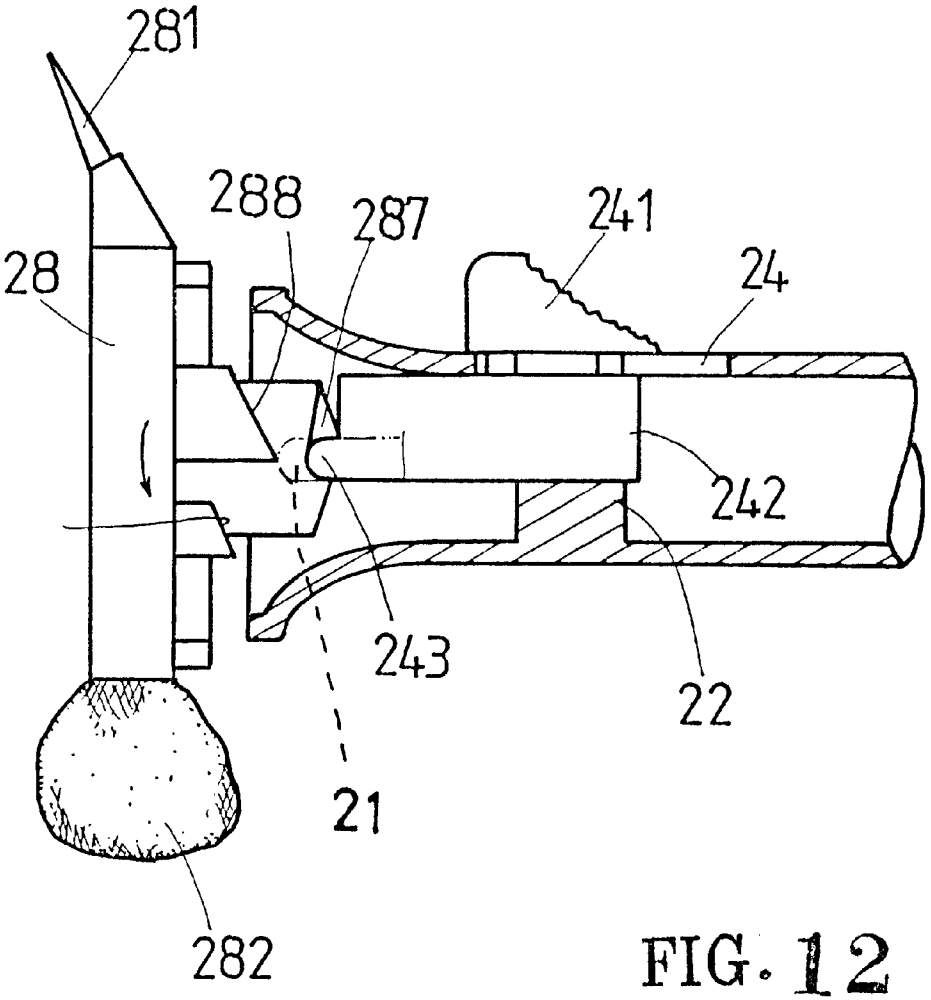
FIG. 12 illustrates how to turn the brush assembly up side down.
Figure 15:
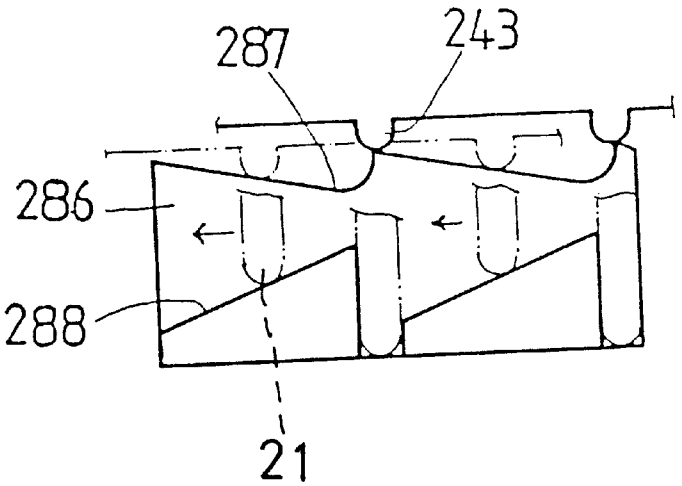
FIG. 15 illustrates the relationship between the tubular portion of the brush assembly and the push member shown in FIG. 14.
Figure 14:
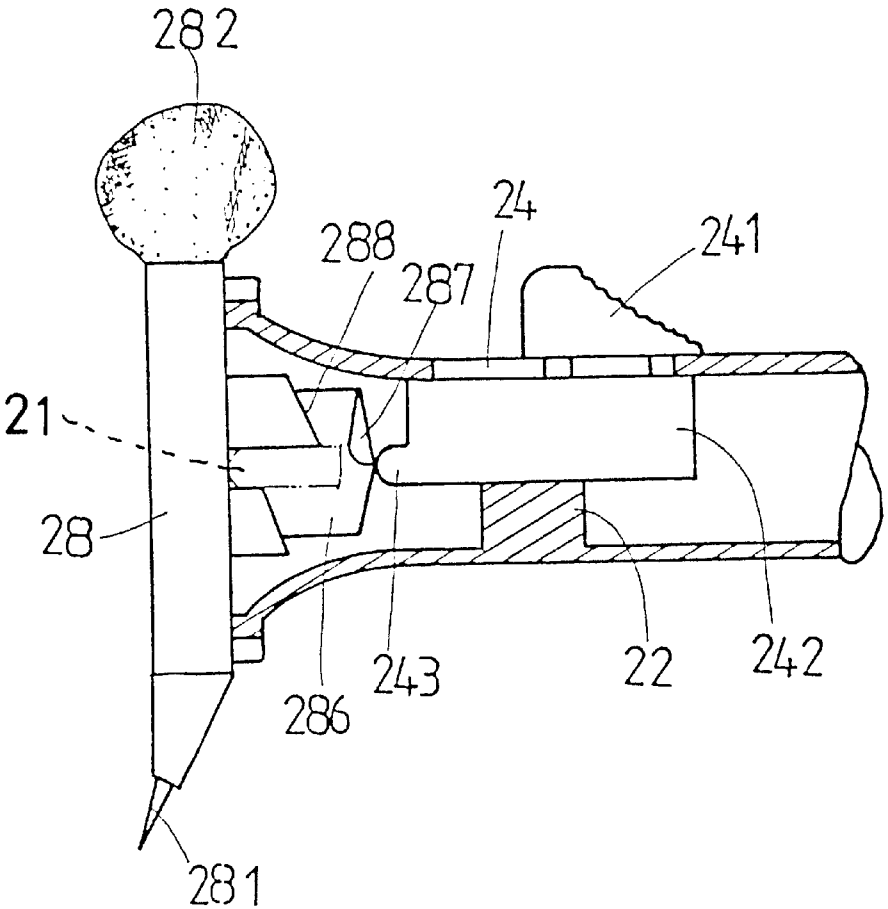
FIG. 14 is a sectional view showing that the brush assembly has been turned up side down.
Figure 17:
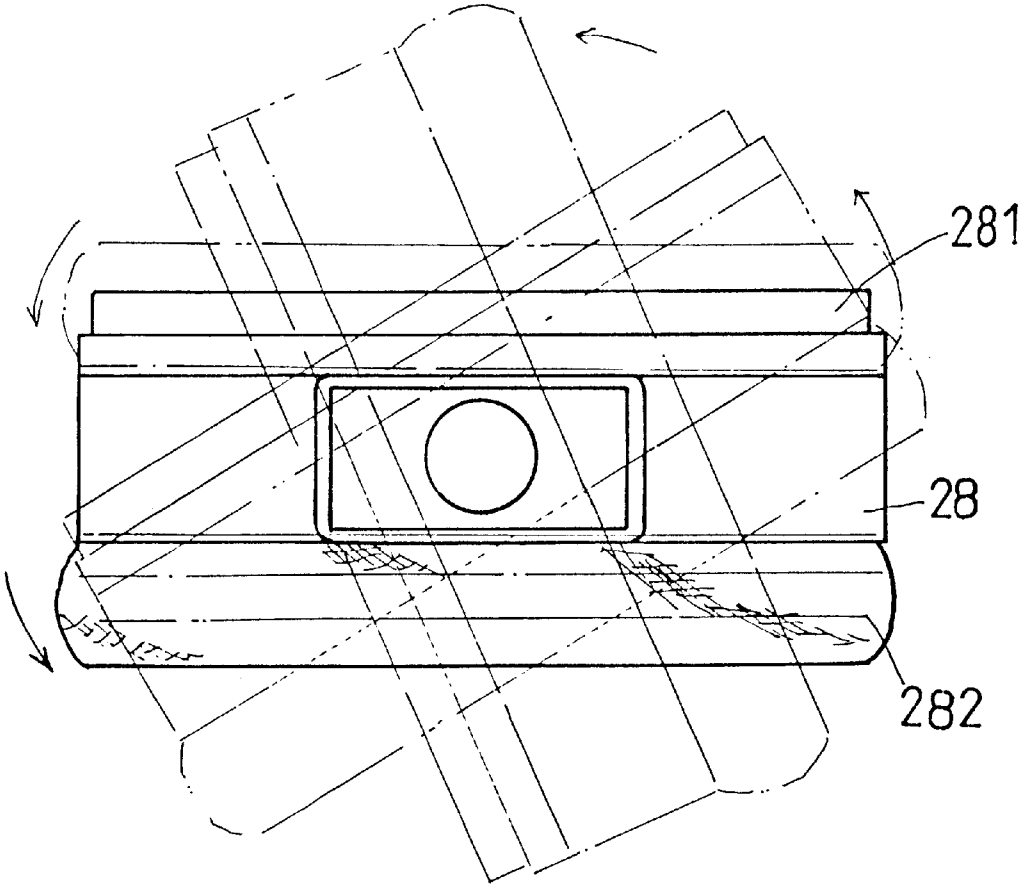
FIG. 17 shows the rotation of the brush head.

Referring to FIGS. 8, 9 10 and 11, when desired to rotate the brush assembly 28 up side down for different purpose, it is only necessary to push the pushbutton 241 forward thereby causing the push member 242 to push the cylindrical member 286 to go outwardly to disengage from the guiding members 21 of the tool head 2, and then rotate the brush assembly 28 up side down (see FIGS. 12 and 13) to turn the lower track 288 of the cylindrical member 286 on the guiding members 21 thereby causing the guiding members 21 to go into the grooves 2881 (see FIGS. 14 and 15). As shown in FIG. 17, the brush assembly 28 can be rotated for different cleaning purposes as desired.

Figure 18:
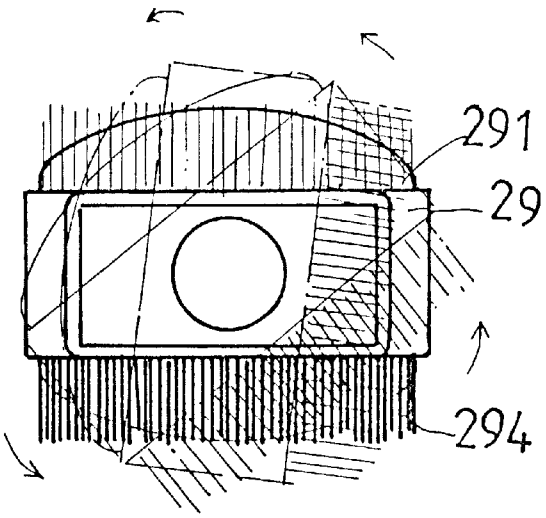
FIG. 18 shows the rotation of a second preferred brush head.
Figure 19:
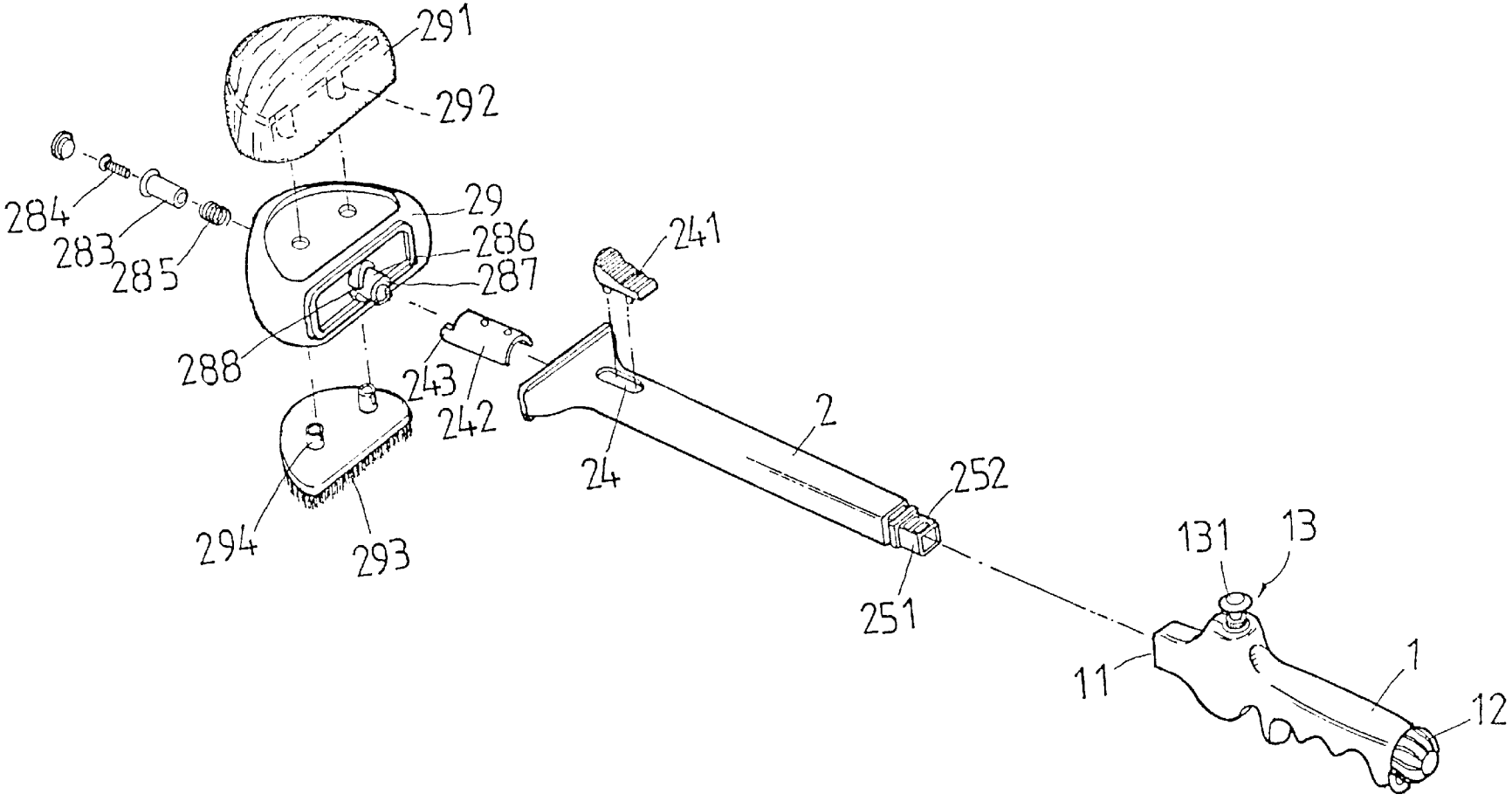
FIG. 19 is an exploded view of the second preferred brush head.

FIGS. 18 and 19 illustrate an another preferred brush assembly 29 which is designed for polishing shoes. As shown, the brush assembly 29 is substantially similar to the brush assembly 28 except that the former has holes for receiving pins 291 of a sponge 292 adapted to engage with tubular portions 294 of a brush 293.

Figure 20:
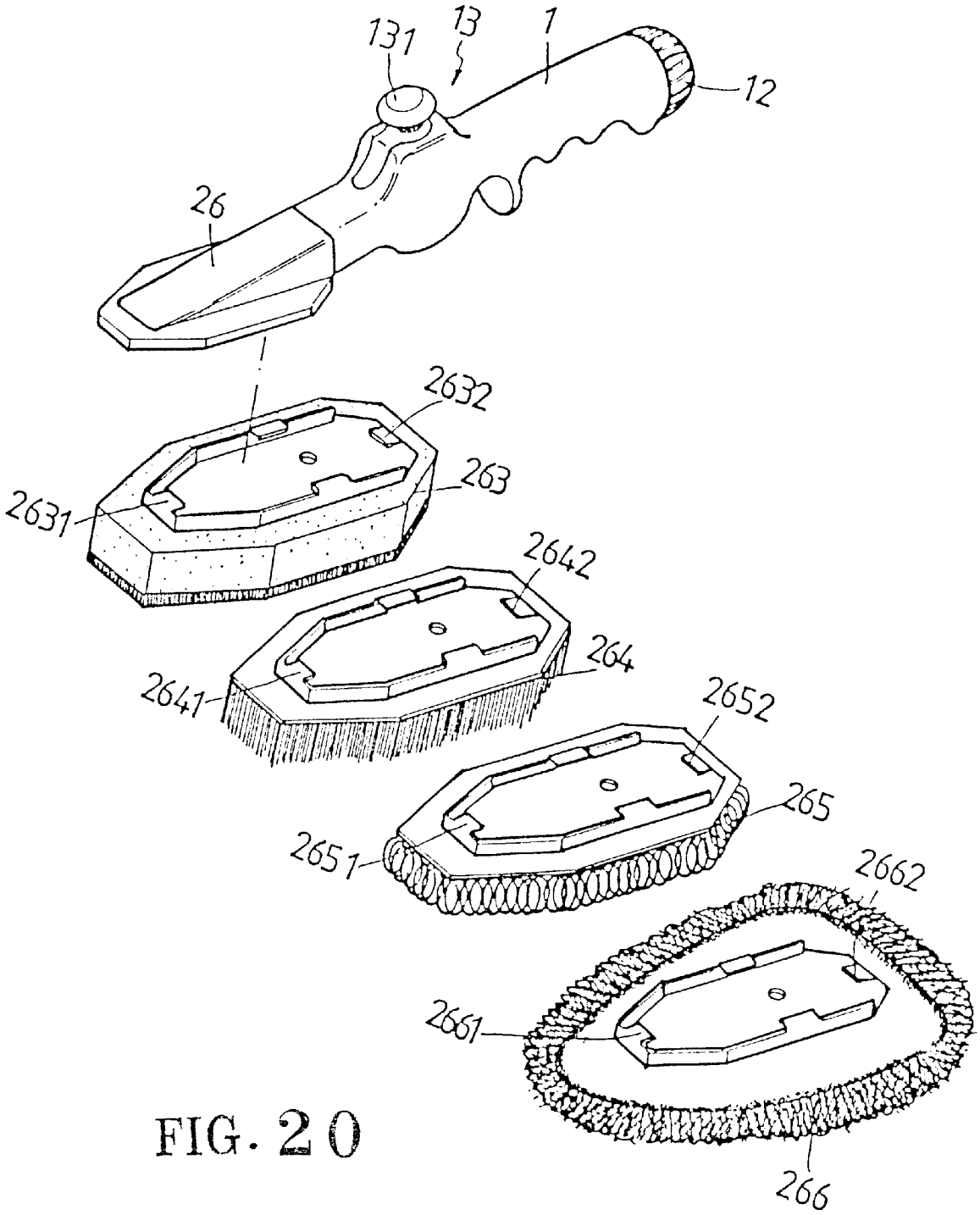
FIG. 20 illustrates how the tool head is engageable with different brush assemblies.

FIG. 20 illustrates how the tool head 26 is engaged with different brush heads 263, 264, 265 and 266. As shown, the brush heads 262, 264, 265 and 266 are provided with fixing lugs 2631 and 2632, 2642 and 2642, 2651 and 2652, and 2661 and 2662 at the top which are forced into engagement with the tool head 26.

Figure 21:
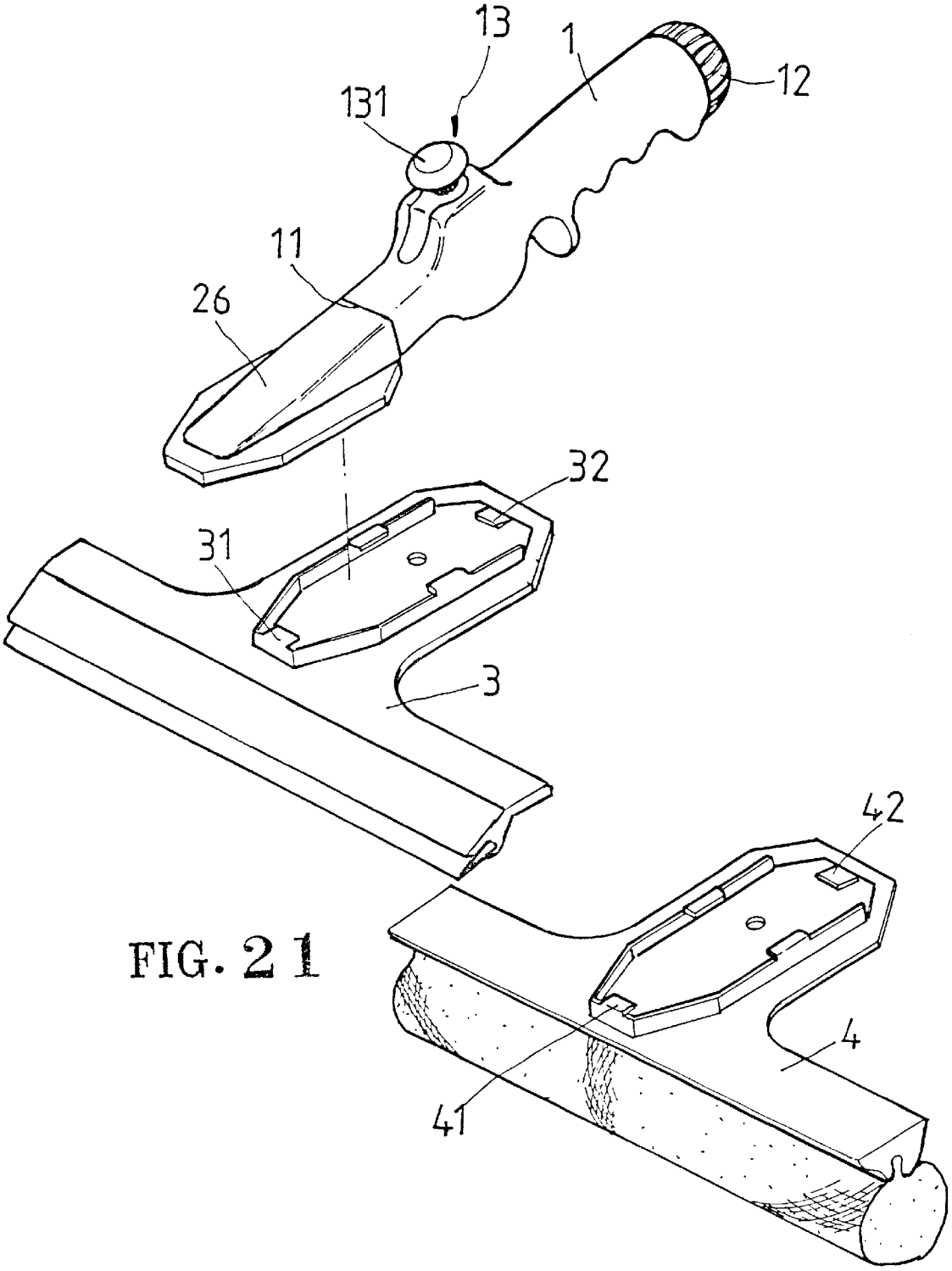
FIG. 21 illustrates how the tool head is engageable with a scraper and a sponge.

FIG. 21 illustrates how the tool head 26 is engageable with a scraper 3 with fixing lugs 31 and 32 at the top and a sponge 4 with fixing lugs 41 and 42.

Figure 22:
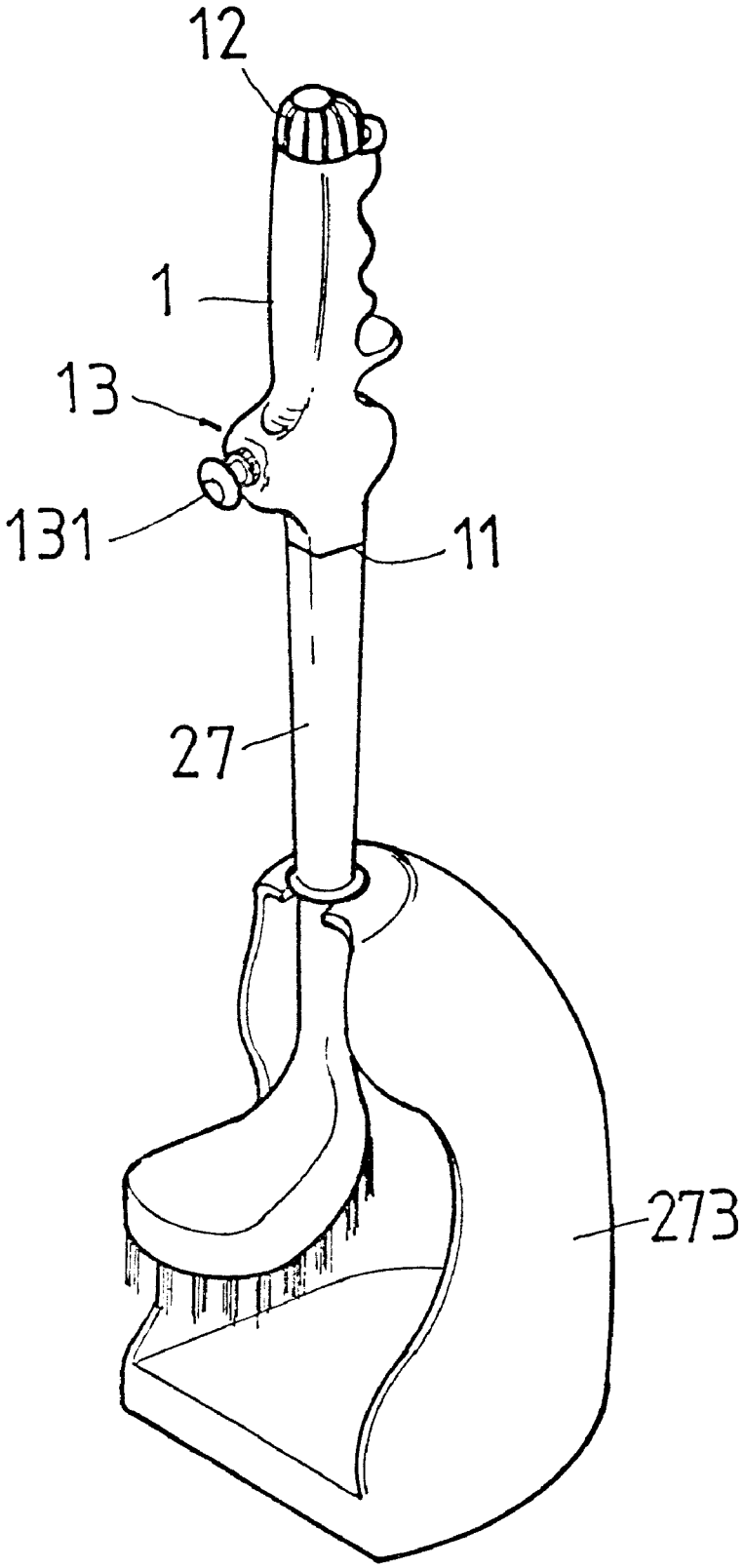
FIG. 22 is a perspective view illustrating the arrangement of the tool head (for cleaning toilets) in a holder.

FIG. 22 is a perspective view illustrating the arrangement of the tool head 27 (for cleaning toilets) on a base 273.

Figure 23:
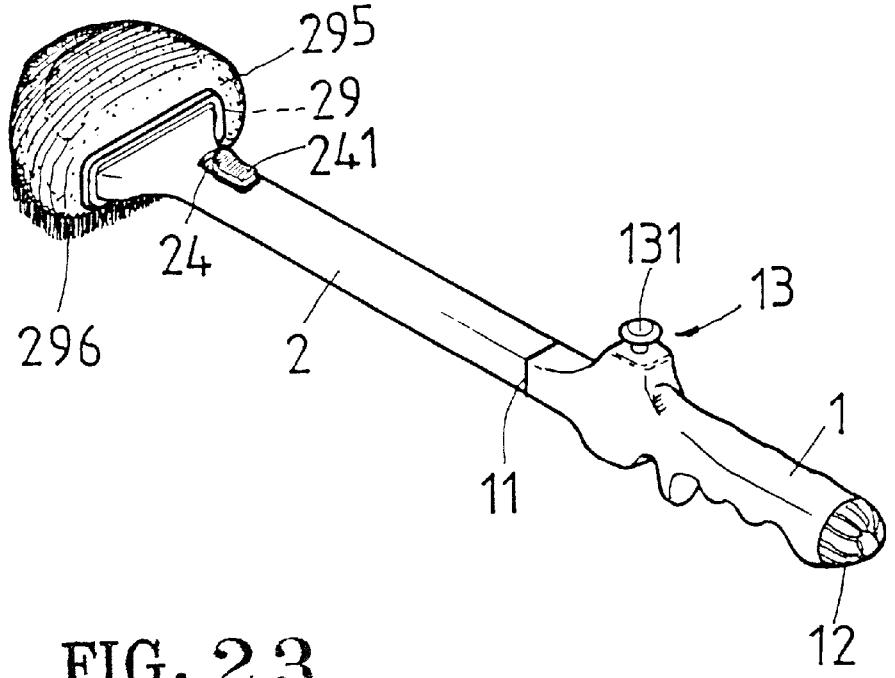
FIG. 23 illustrates a tool head provided with woolens at the top and a brush at the bottom.
Figure 24:
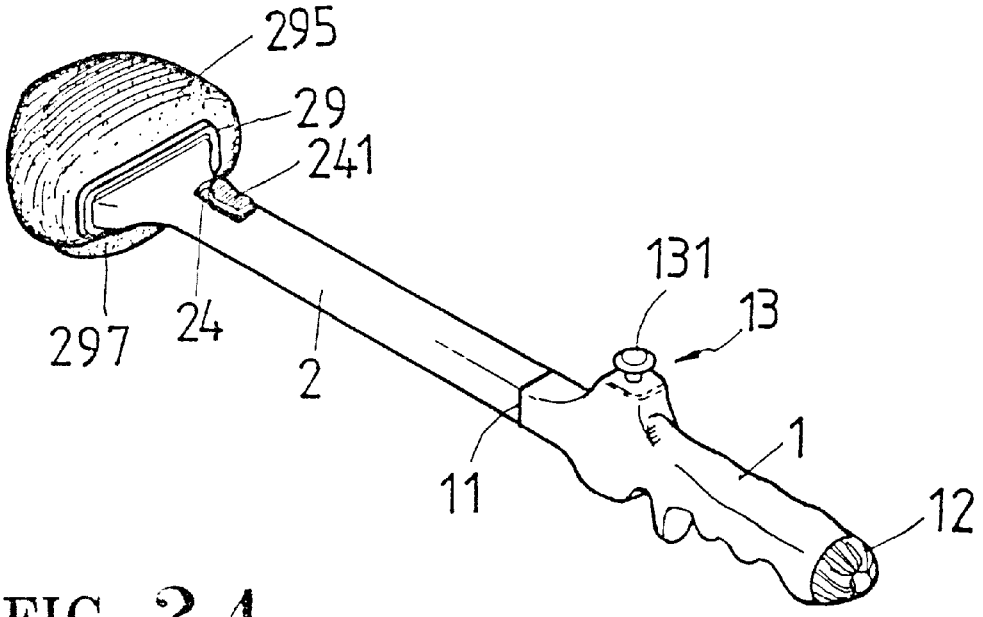
FIG. 24 illustrates a tool head provided with woolens at the top and a sponge at the bottom.
Figure 25:
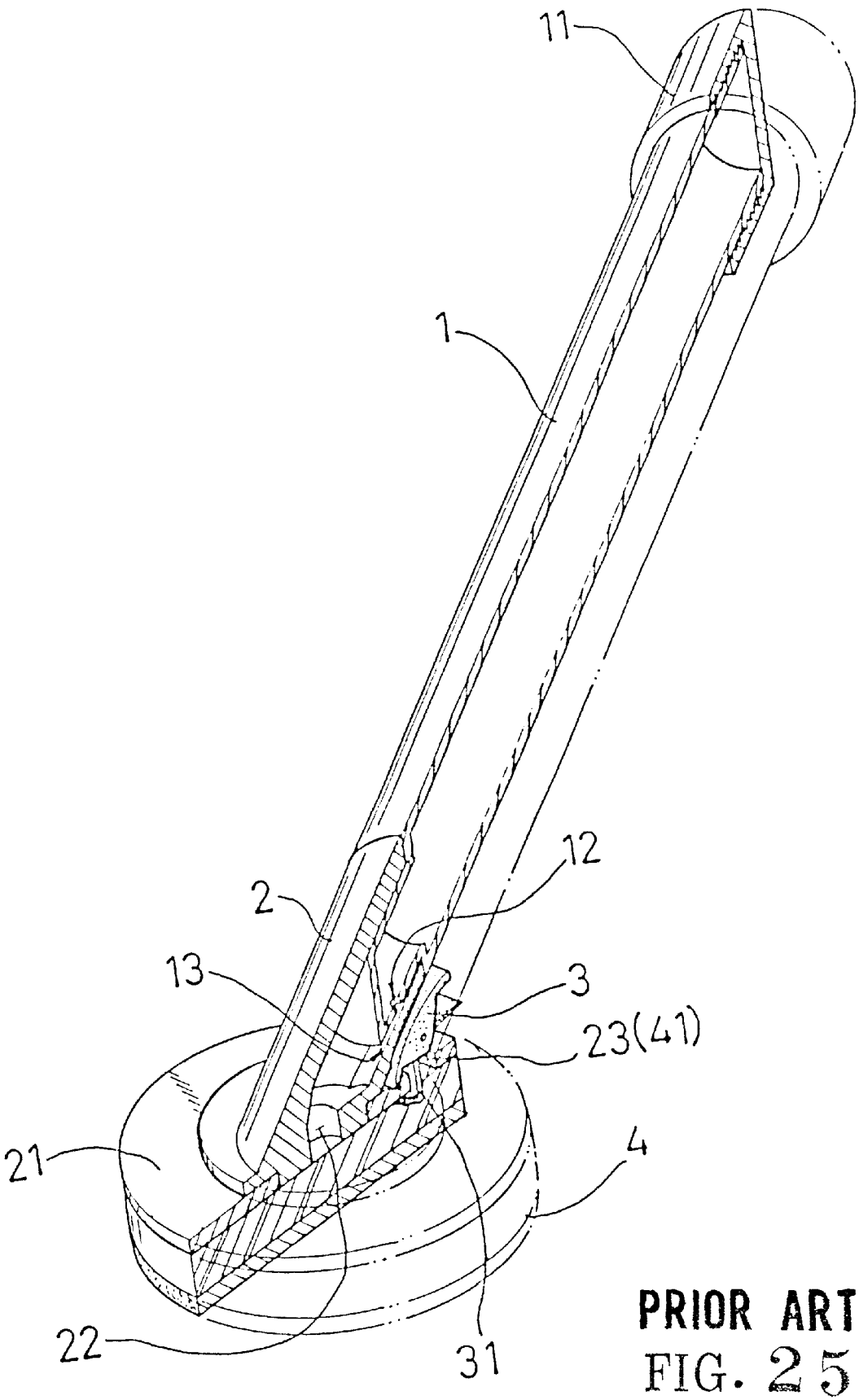
PRIOR ART FIG. 25
FIG. 25 is a cutaway of a cleaning brush according to the prior art.
Figure 26:
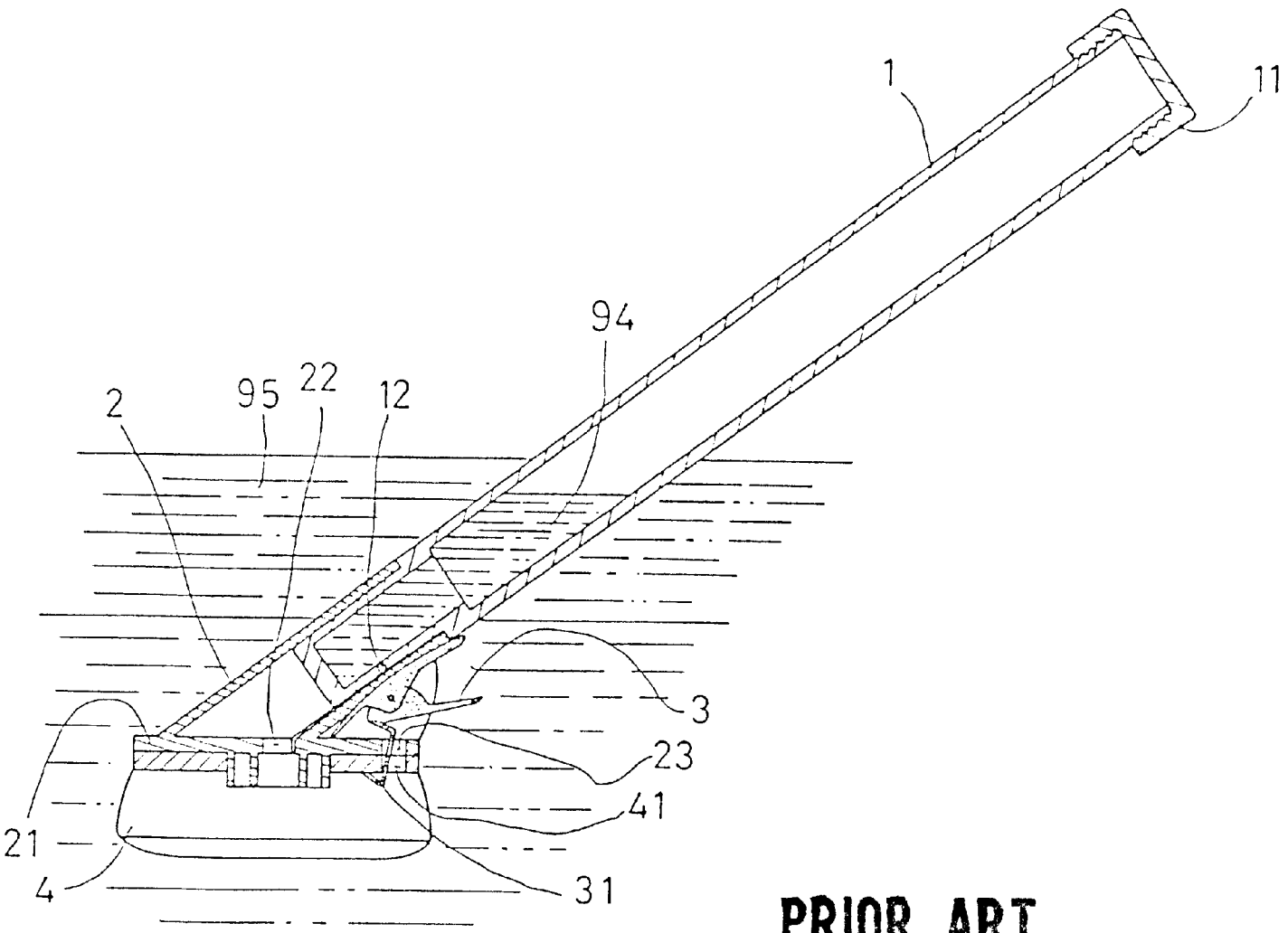
PRIOR ART FIG. 26
FIG. 26 is an applied view of the cleaning brush of FIG. 25, showing the brush head rubbed against the floor in a wet area.
Figure 27:
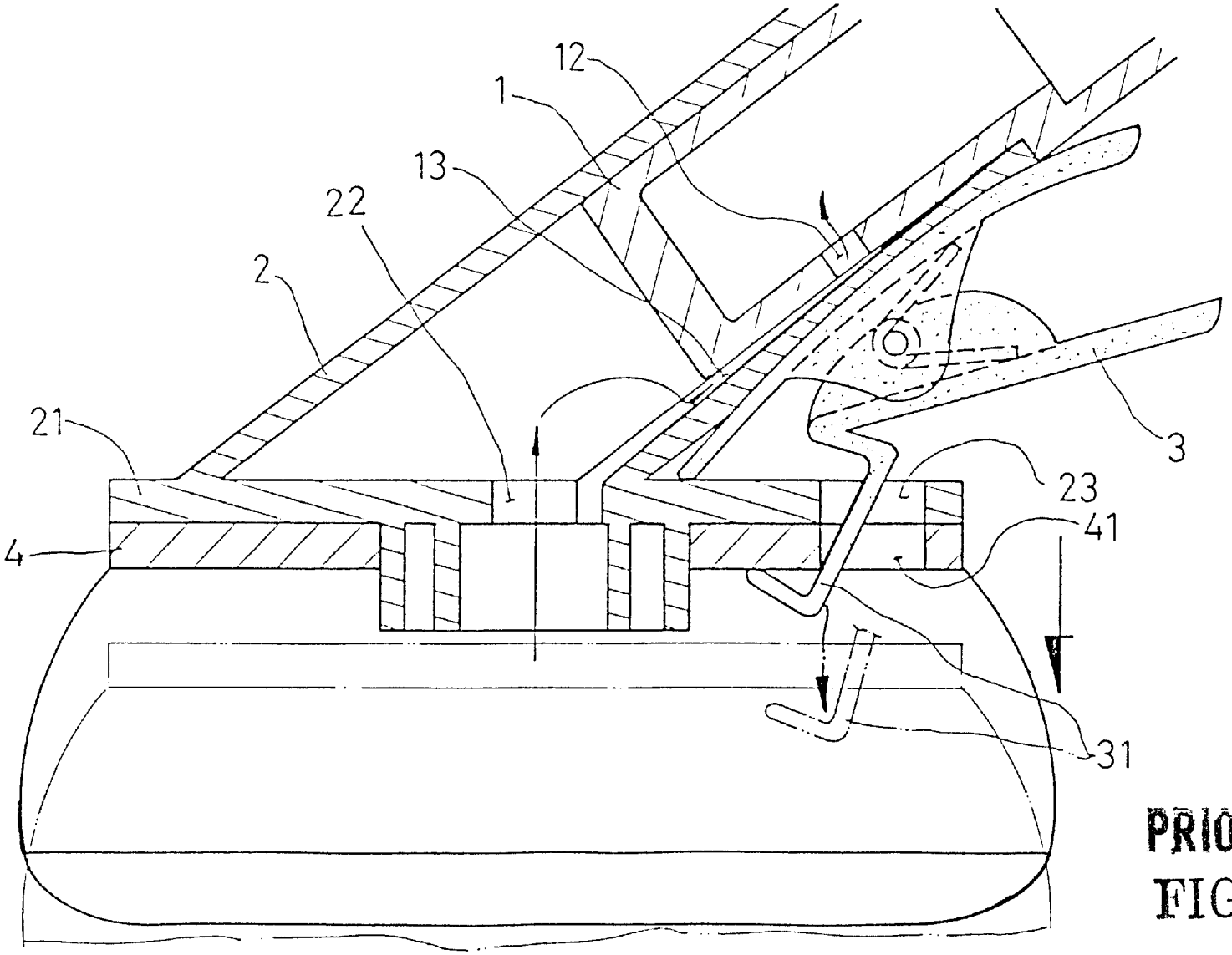
PRIOR ART FIG. 27
FIG. 27 is a partial view in an enlarged scale of the cleaning brush shown in FIG. 26.
Figure 28:
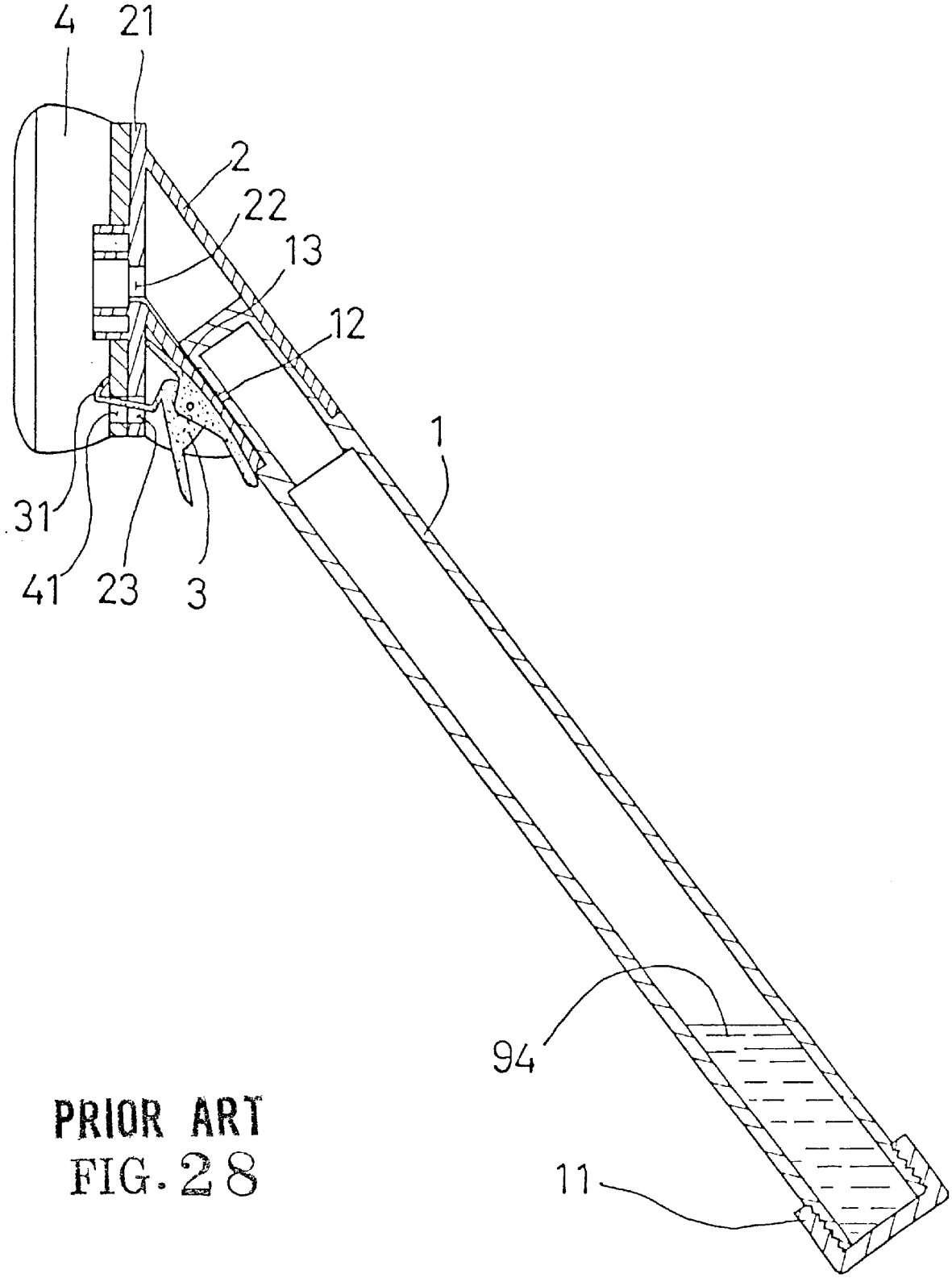
PRIOR ART FIG. 28
FIG. 28 is another applied view of the cleaning brush of FIG. 25, showing the brush head lifted, and the detergent gathered at one end of the handle remote from the brush head.
Figure 29:
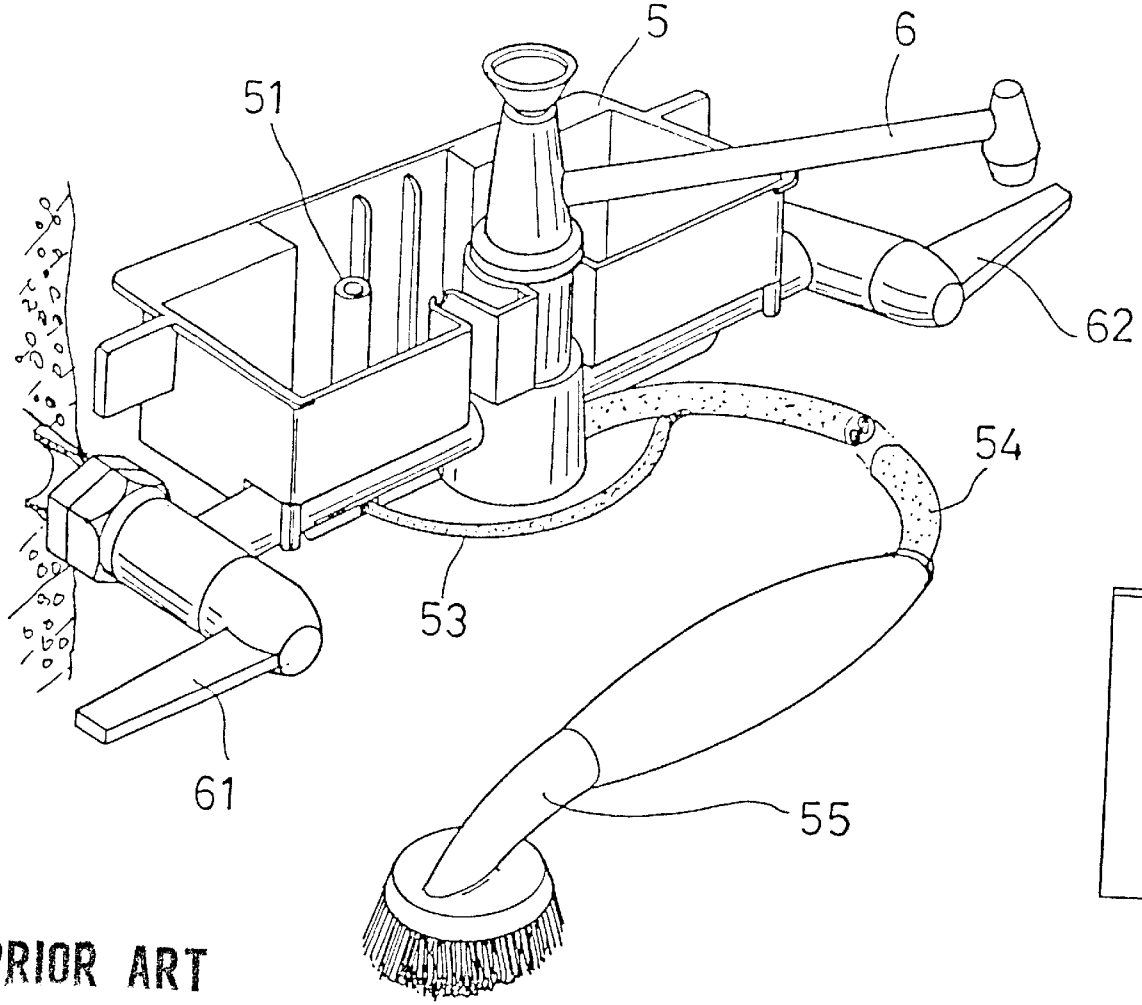
PRIOR ART FIG. 29
FIG. 29 is an elevational view of a household cleaning equipment according to the prior art.
Figure 30:
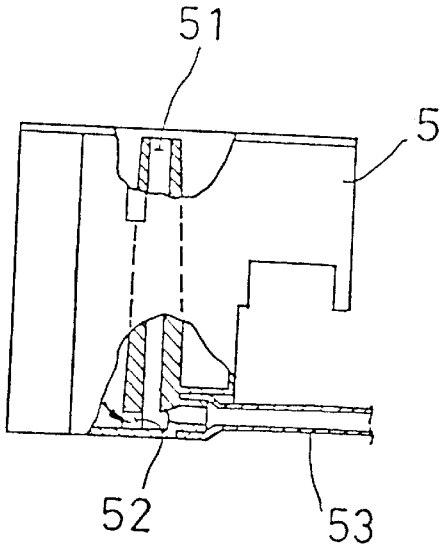
PRIOR ART FIG. 30
FIG. 30 is a sectional view in en enlarged scale of a part of the household cleaning equipment of FIG. 29, showing the detergent supply tube connected to the bottom hole of the upright venturi tube.
Figure 31:
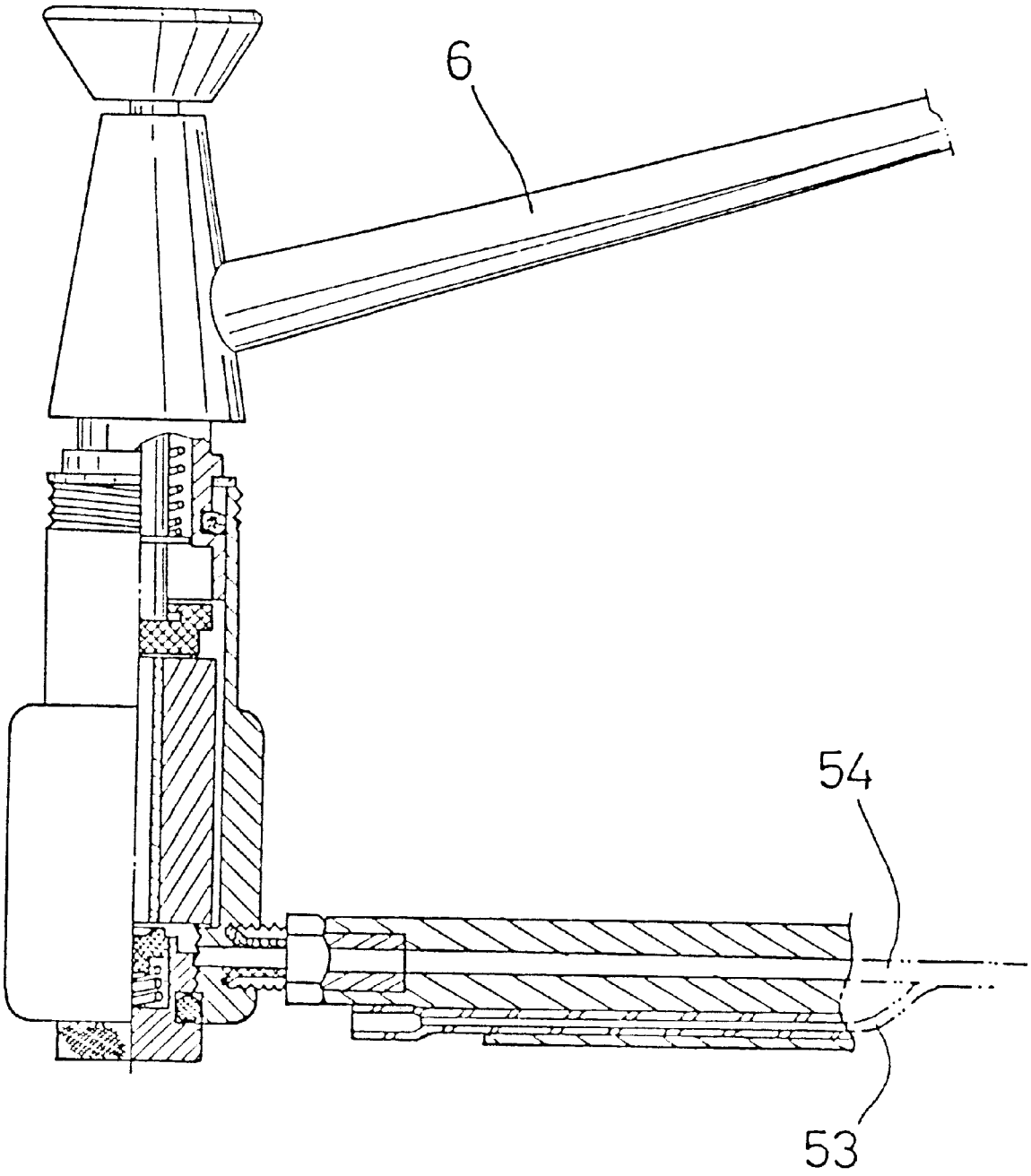
PRIOR ART FIG. 31
FIG. 31 is a sectional view in en enlarged scale of a part of the household cleaning equipment of FIG. 29, showing the detergent supply tube connected to the hose.

FIGS. 23 illustrates the tool head 2 provided with woolens 295 at the top and a brush 296 at the bottom. FIG. 24 shows that the tool head 2 is provided with woolens 295 at the top and a sponge 297 at the bottom.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A household cleaning equipment comprising:

an elongated hollow handle provided with an end cap for permitting a detergent to be filled therein;

a depressing assembly mounted on said handle and including a cylinder fitted within said handle, a collar threadedly engaged with an upper end of said cylinder to fix said cylinder in place, a button arranged above said collar, a piston fitted within said cylinder, a shaft having an upper end extending upwardly through said collar to engage with said button and a lower end extending downwardly to engage with said piston, a first ball fitted within said cylinder, a first spring arranged within said cylinder and having an upper end bearing against a bottom of said piston and a lower end bearing against said first ball, and an inlet connector connected to a lower end of said cylinder, said cylinder being formed with a conical tubular portion which makes an angle with said cylinder, a second ball fitted within said conical tubular portion, a second spring having a lower end bearing against second ball, an outlet connector connected with an upper end of said conical tubular portion;

a tool head formed with an elongated opening close to a front end adapted to receive a pushbutton, a push member fitted within said tool head and fixedly engaged with a bottom of said pushbutton, said push member having a protuberance at a front end thereof, said tool head being provided at the interior with two guiding members transversely extending from two opposite inner walls, a fixing member arranged between said guiding members and having a threaded hole at the center and two arms at two opposite sides, and an orifice at the bottom for connecting to the outlet connector via a pipe; and a brush assembly provided with a tubular portion at the central portion, said tubular portion having an inwardly extending flange, a spring-loaded tubular member fitted within said tubular portion and having an inner end fixedly mounted with said handle, said tubular portion being formed with an upper spiral track at an end, a lower spiral track on a cylindrical surface and close to another end, and two grooves at two opposite sides extending longitudinally through said lower spiral track.

2. The household cleaning equipment as claimed in claim 1, wherein said brush assembly is provided with a scraper at one side and a sponge at another.

3. The household cleaning equipment as claimed in claim 1, wherein said tool head is engageable with fixing strips of said brush assemblies.

4. The household cleaning equipment as claimed in claim 1, wherein said brush head is designed for cleaning toilets.

5. The household cleaning equipment as claimed in claim 1, wherein said brush headis formed with holes adapted to receive fixing pins of a sponge at one side and a brush at another side.

6. The household cleaning equipment as claimed in claim 1, wherein said tool head is engageable with a scraper and a sponge.

7. The household cleaning equipment as claimed in claim 1, wherein said brush assembly has woolens at one side and a brush at another side.

8. The household cleaning equipment as claimed in claim 1, wherein said brush assembly has woolens at one side and a sponge at another side.

* * * * *